US011589682B2

(12) United States Patent
Rosenthal

(10) Patent No.: US 11,589,682 B2
(45) Date of Patent: Feb. 28, 2023

(54) INFANT CHAIRS

(71) Applicant: Thorley Industries, LLC, Pittsburgh, PA (US)

(72) Inventor: Jared Rosenthal, Pittsburgh, PA (US)

(73) Assignee: Thorley Industries, LLC, Pittsburgh, PA (US)

( * ) Notice: Subject to any disclaimer, the term of this patent is extended or adjusted under 35 U.S.C. 154(b) by 0 days.

(21) Appl. No.: 17/024,401

(22) Filed: Sep. 17, 2020

(65) Prior Publication Data

US 2021/0085094 A1 Mar. 25, 2021

Related U.S. Application Data

(60) Provisional application No. 62/902,718, filed on Sep. 19, 2019.

(51) Int. Cl.
*A47D 1/00* (2006.01)

(52) U.S. Cl.
CPC ..... *A47D 1/0085* (2017.05); *A47D 1/004* (2013.01)

(58) Field of Classification Search
CPC ..... A47D 1/008; A47D 1/0081; A47D 1/0085
USPC ..... 297/148, 149
See application file for complete search history.

(56) References Cited

U.S. PATENT DOCUMENTS 4,842,331 A 6/1989 Waples
5,489,138 A 2/1996 Mariol et al.
5,810,432 A 9/1998 Haut et al.
6,089,654 A 7/2000 Burstein
7,008,018 B2 3/2006 Chen
7,419,210 B2 9/2008 Nolan et al.
7,673,942 B2 3/2010 Tuckey et al.
7,810,885 B2 10/2010 Chen et al.
7,922,244 B2 4/2011 Bearup
8,157,327 B2 * 4/2012 Tomasi ..... A47D 1/002 297/344.14
8,408,650 B2 4/2013 Jacobs et al.
8,696,055 B2 4/2014 Stolarz et al.
8,960,788 B2 2/2015 Chuah
9,119,481 B2 9/2015 Varney et al.
9,560,919 B2 2/2017 Terhune et al.
9,936,817 B2 4/2018 Horst et al.
10,080,443 B2 9/2018 Terhune et al.
2011/0227384 A1 * 9/2011 Huntsberger ..... A47D 13/105 297/250.1
2018/0279800 A1 10/2018 Terhune et al.

* cited by examiner

*Primary Examiner* — Sarah B McPartlin
(74) *Attorney, Agent, or Firm* — Perman & Green, LLP

(57) ABSTRACT

An infant supporting chair including a frame, a seat movably supported on the frame, a unitary tray and a cooperative guidance and latching system. The cooperative guidance and latching system being configured to magnetically pull the unitary tray toward at least one latching position when the unitary tray is in range of the at least one latching position relative to the seat, releasably secure the unitary tray to the seat when the unitary tray is engaged to the at least one latching position, and slidably position the unitary tray relative to the seat when the unitary tray is partially disengaged from the at least one latching position.

20 Claims, 13 Drawing Sheets

INFANT CHAIRS

CROSS-REFERENCE TO RELATED APPLICATIONS

This application is a non-provisional and claims the benefit of U.S. provisional patent application No. 62/902,718 filed on Sep. 19, 2019, the disclosure of which is incorporated herein by reference in its entirety.

BACKGROUND

1. Field

The exemplary aspects of the present disclosure generally relate to infant chairs, and more particularly, to high chairs for infants and children.

2. Brief Description of Related Developments

High chairs may comprise a variety of shapes, sizes, and features. For example, high chairs may provide a safe and comfortable place for infants to sit while eating or drinking. High chairs may include features for securing an infant and/or for preventing and/or limiting the spillage of food and/or drink.

A conventional high chair generally consists of a frame, a seat, and a food tray. The seat is for seating a child and may be moved upwards on the frame. The food tray rests on the seat for holding food and drink. At mealtimes, infants and small children are placed in the high chair to be fed. The child may be strapped into the seat, and then the high chair tray is attached in front of the child.

However, conventional high chairs suffer from various deficiencies that can make such high chairs difficult to use. For instance, conventional high chairs require the user to carefully align the tray with two rails when attaching the tray to the seat. The tray is then pushed in one, and only one, direction for attachment. This can be difficult to do with one hand. There exist today multi-layer trays that provide magnetic guidance and latching systems that can assist the user in aligning and placing the tray onto the seat. However, these multi-layer trays require additional and complex components to attach the tray to the seat and also slide the tray in and out relative to the seat. These additional and complex components increase the complexity of the manufacturing process and add significant cost to manufacture a high chair.

Accordingly, a need exists for an improved high chair that cures such deficiencies.

It is noted that the design and/or utility features disclosed in U.S. Pat. No. D730,070, entitled HIGH CHAIR, the entire disclosure of which is hereby incorporated by reference herein, may be employed and incorporated in the various aspects of the present disclosure. The infant chair features as described in United States Patent Publication No. 2018/0279800 A1 published on Oct. 4, 2018 and entitled "Infant Chairs", U.S. Pat. No. 9,560,919 issued on Feb. 17, 2017 and U.S. Pat. No. 10,080,443 issued on Sep. 28, 2018, the disclosures of which are incorporated herein in their entirety, may also be employed and incorporated in the various aspects of the present disclosure.

BRIEF DESCRIPTION OF THE DRAWINGS

The foregoing aspects and other features of the disclosed embodiment are explained in the following description, taken in connection with the accompanying drawings, wherein.

DETAILED DESCRIPTION

Figure 1A:
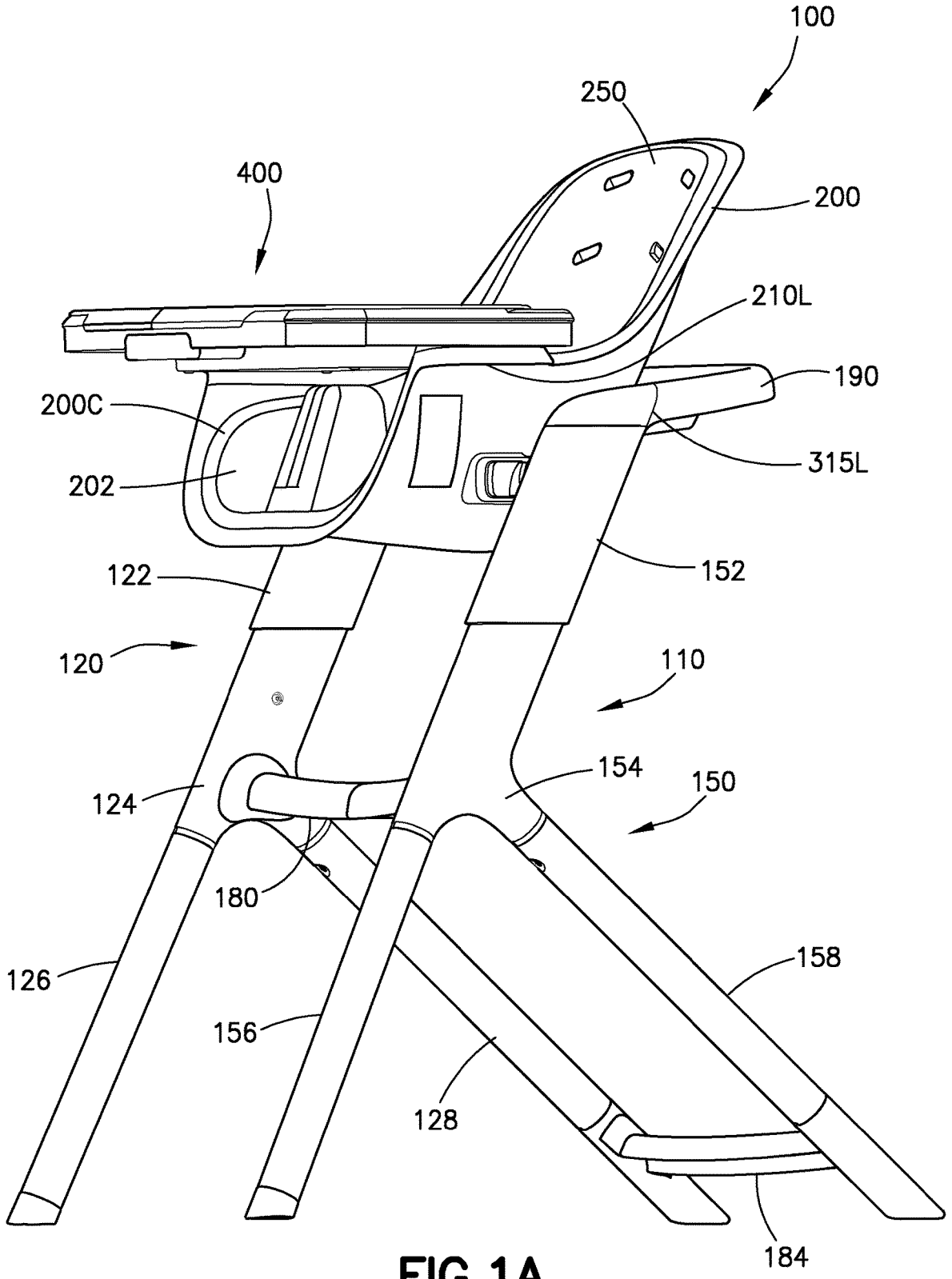
FIGS. 1A and 1B are schematic illustrations of an infant-supporting chair apparatus, incorporating aspects of the present disclosure, in a standing upright configuration.
Figure 1B:
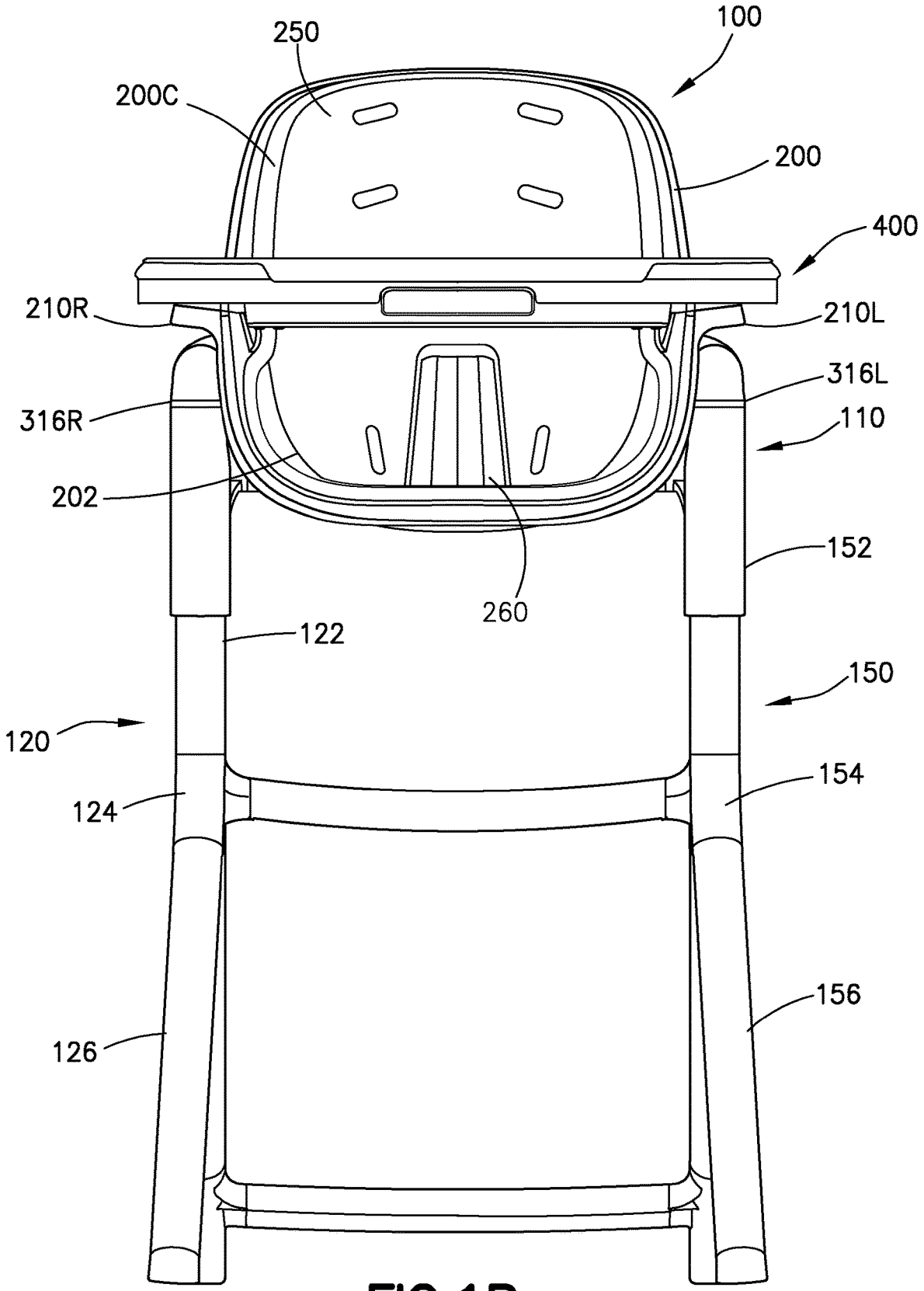

FIGS. 1A and 1B illustrate an exemplary "infant-supporting" chair apparatus 100 (also referred to herein as infant-supporting chair 100) in the form of an infant high chair, in accordance with aspects of the present disclosure. Although the aspects of the present disclosure will be described with reference to the drawings, it should be understood that the aspects of the present disclosure can be embodied in many forms. In addition, any suitable size, shape or type of elements or materials could be used.

Still referring to FIGS. 1A and 1B, the term "infant-supporting" as used herein is intended to encompass infants as well as small children that are commonly fed utilizing "high chairs" and high-chair like aspects. Moreover, as the present disclosure proceeds, the person of ordinary skill in the art will readily appreciate that certain features of the chairs and aspects of the chair assembly disclosed herein may find equal utility in use in connection with chair and chair arrangements that may be more specifically tailored to support larger children or adults without departing from the spirit and scope of the present invention. In the illustrated aspect, the infant-supporting chair 100 includes a frame assembly 110 that is configured to movably support a seat 200 in a plurality of heights above the floor or other surface upon which the frame assembly 110 is supported. As will be discussed in further detail below, the infant-supporting chair 100 also includes a tray assembly 400 that is removably attachable or "releasably mountable" to the seat 200.

The frame assembly 110 is fabricated from multiple components that may be fabricated from various structural materials. For example, the components of the frame assembly 110 may be fabricated from extruded aluminum or from steel or other metal material as well as from structural blow-molded plastics and other polymer materials and combinations thereof. The metal components may be painted or otherwise coated or encapsulated in anti-microbial and hydrophobic plastics or be coated or covered with powder coating or other suitable coating materials to achieve a desired aesthetic appearance for example.

The frame assembly components may be joined together by fasteners or fastener medium such as, for example, screws, bolts, spring-biased detents, rivets, bent tabs, molded snap features, interference fits, crushable features, hinges, tongue-in-groove arrangements, and/or in any other suitable fasteners. In some aspects, the fasteners may be removable to facilitate disassembly by the user for storage and/or transport purposes and, in other aspects, the fasteners or fastener medium may not be removable. For example, in other aspects, the frame assembly components may be joined together by welding, adhesive, etc. In still other embodiments, the frame assembly may be formed in one piece. For example, the frame assembly may be formed from structural, blow molded plastic or other suitable materials.

In the aspect illustrated in FIGS. 1A and 1B, the frame assembly 110 includes a right side structure 120 and a left side structure 150, the terms "left" and "right" being used herein for ease of explanation and are not limiting of the frame assembly 110 structure. The right side structure 120 includes a right vertical strut 122 that is attached to a right transition joint 124. A right front leg 126 and a right rear leg 128 are attached to the right transition joint 124. Similarly, the left side structure 150 includes a left vertical strut 152 that is attached to a left transition joint 154. A left front leg 156 and a left rear leg 158 are attached to the left transition joint 154 as shown. A front cross strut 180 is attached to the right transition joint 124 and the left transition joint 154 and extends therebetween as shown. A rear strut 184 is attached to the right rear leg 128 and the left rear leg 158 and extends therebetween. A curved grab rail 190 may also be attached to the right vertical strut 122 and the left vertical strut 152 and extends therebetween. The grab rail 190 may provide a convenient means for moving the infant-supporting chair 100 into a desired location. In the illustrated aspect, the legs, struts and connectors are fabricated from extruded metal such as aluminum or other suitable materials and are coupled together by screws, not shown, or other suitable fastener arrangements, but in other aspects, any suitable materials and fasteners (removable or non-removable) may be employed as noted above.

Referring still to FIGS. 1A and 1B, the seat 200 includes a base 202, a right armrest 210R, and left armrest 210L. The right armrest 210R and the left armrest 210L extend from opposite sides of the seat base 202. An infant (or "occupant") can be seated on the base 202 between the right and left armrests 210R, 210L of the seat 200. The seat 200 also includes a backrest 250 that extends upward from a rear side of the base 202. The backrest 250 is configured to support an infant (or occupant) positioned in the seat 200 in an upright and/or seated position. In other aspects, the seat 200 may not include a backrest. In the aspect illustrated in FIGS. 1A and 1B, the seat 200 includes a restraint post 260 (see FIG. 1B) that extends upward from the base 202. The restraint post 260 may be configured to assist in securing and restraining an infant or occupant who is positioned in the seat 200. In various aspects, the seat 200 may be fabricated from plastic polypropylene, acrylonitrile butadiene styrene ("ABS"), polyoxymethylene ("POM"), nylon polystyrene (Nylon PS), etc. wherein the restraint post 260 is integrally formed therewith. In other aspects, the restraint post 260 is attached to the base 202 by screws, bolts snap features, and/or any other suitable removable fasteners, such as those noted above, for assembly purposes and to facilitate positioning of the restraint post 260 in multiple positions on the seat and/or detachment therefrom. In other aspects, the restraint post 260 may be non-removably affixed to the base by adhesive, rivets, an/or by any other suitable non-removable fasteners such as those noted above. The seat 200 may also include a removable insert cushion 200C. In at least one aspect, for example, the insert cushion 200C comprises a one-piece seat insert that is conformed to at least a portion of the seat 200 and is removable for cleaning purposes. In still other aspects, the insert cushion 200C may be formed in multiple pieces from a cushion material or materials. The seat 200 may include a multi-piece restraint system (such as a two-point harness, a three-point harness, a four-point harness, a five point harness, or any other suitable restraint) for securing the infant within the seat 200 such as described in, for example, United States Patent Publication No. 2018/0279800 A1 published on Oct. 4, 2018 and entitled "Infant Chairs", U.S. Pat. No. 9,560,919 issued on Feb. 17, 2017 and U.S. Pat. No. 10,080,443 issued on Sep. 28, 2018 the disclosure all of which are incorporated herein in their entirety.

Figure 8:
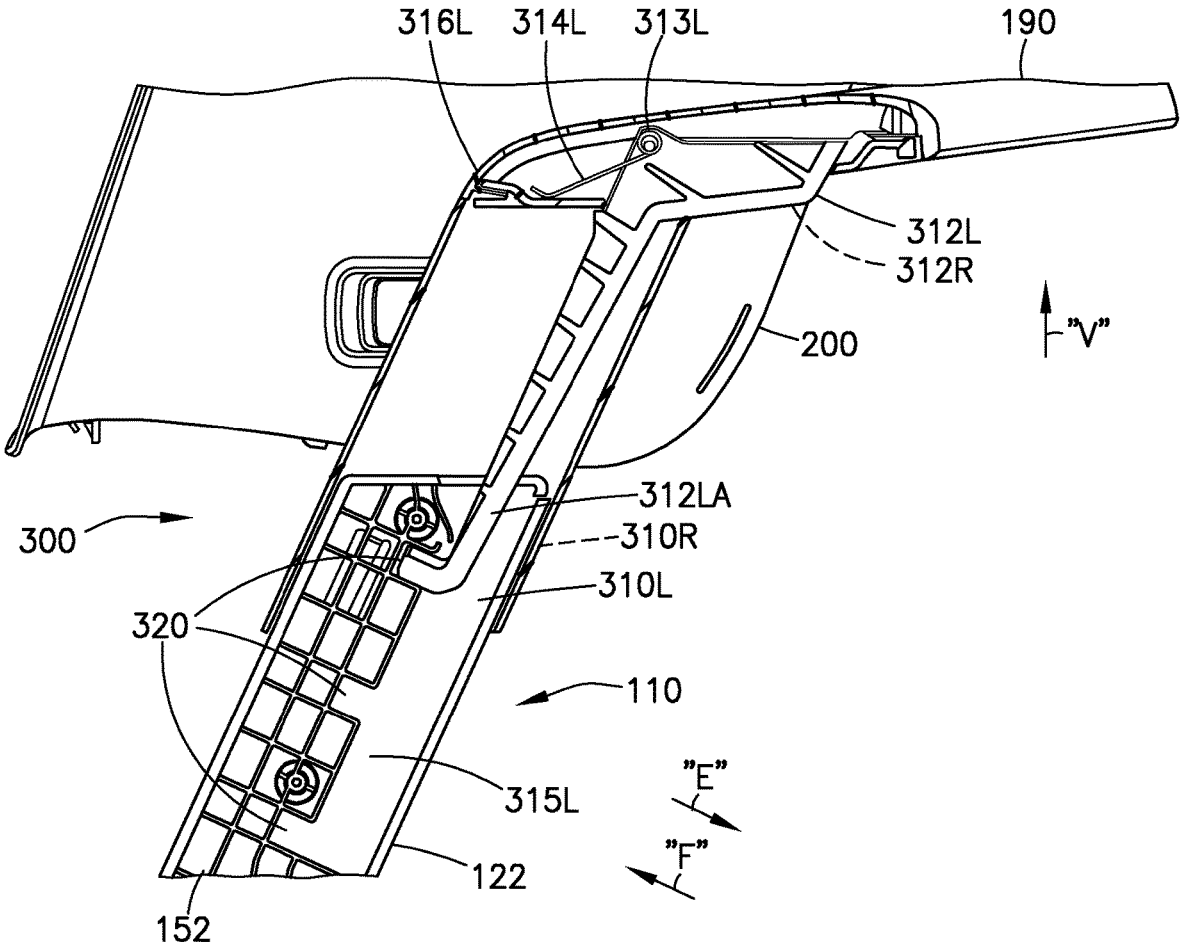
FIG. 8 schematically illustrates a seat positioning system height assembly of the infant-supporting chair apparatus of FIGS. 1A and 1B in accordance with aspects of the present disclosure.

In the illustrated aspect, referring also to FIG. 8, the seat 200 is movably coupled to the frame assembly 110 by a seat positioning system generally designated as 300 (see FIG. 8). In at least one aspect of the present disclosure, for example, the seat positioning system 300 comprises a right seat height latching assembly 310R and a left seat height latching assembly 310L, only the left seat height latching assembly 310L is shown in FIG. 8 (noting the right seat height latching assembly 310R is located behind the left seat height latching assembly 310L and is obscured by the left seat height latching assembly 310L in the view illustrated in FIG. 8). In the illustrated aspect, the right and left seat height latching assemblies 310R, 310L are identical in construction and operation and are "mirror images" of one another such that only the left seat height latching assembly will be described. FIG. 8 illustrates various portions of the left seat height latching assembly 310L. The left seat height latching assembly 310L includes a left height adjust lever 312L that is configured to slidably engage a left recess plate 315L. The left recess plate 315L is attached to the left vertical strut 152 and has three recess slots 320. In other aspects, the recess plate 315L may have any number of recess slots 320.

In operation (noting the right height adjustment lever 312R has a substantially similar operation to the left height adjustment lever 312L), a user squeezes the left height adjustment lever 312L in the direction of arrow V. The left height adjustment lever 312L pivots around a left height lever pin (e.g., pivot point) 313L causing a locking arm 312LA of the left height adjustment lever 312L to rotate or more in the direction of arrow E. Movement of the locking arm 312LA in the direction of arrow E causes the left height adjustment lever 312L to disengage from one of the recess slots 320, where the locking arm 312LA is integral to or other coupled to the left height adjustment lever so as to rotate about the left height lever pin 313L. The user may now raise or lower the seat positioning system 300 to a new height, where the user releases the left height lever 312L causing a left torsion spring 314L to pivot the left height lever 312L and the locking arm 312LA about the left height lever pin (pivot point) 313L moving the locking arm 312LA of the left height lever 312L in the direction of arrow F into another (or the same) recess slot 320.

As previously discussed, the curved grab rail 190 may be attached to the right vertical strut 122 and the left vertical strut 152 and extend therebetween. The curved grab rail 190 may be attached to the right vertical strut 122 and the left vertical strut 152 through a connection interface 316R and 316L (see FIG. 1B) to the right seat height latching assembly 310R and the left seat height latching assembly 310L (connection of the curved grab rail 190 to the left seat height latching assembly 310L is illustrated in FIG. 8 for exemplary purposes, again noting the right seat height latching assembly 310R is substantially similar to the left seat height latching assembly 310L). In the illustrated aspect, the seat 200, the curved grab rail 190, and the right and left seat height latching assemblies 310R, 310L move in unison as the user adjusts the height of the seat 200. In the illustrated aspect, should a user squeeze only one of the height adjustment levers 312L or 312R in the direction of arrow V, the seat 200 will not move vertically along the vertical struts 122, 152 because the other height adjust lever 312R or 312L will remain engaged in the recess slot 320 of the recess plate 315R or 315L. Such arrangement, therefore, may prevent a user from accidentally unlatching the seat 200 when a child is sitting in the seat, as such, the height cannot be adjusted unless the user simultaneously squeezes both the height adjustment levers 312L or 312R in the direction of arrow V.

Figure 7A:
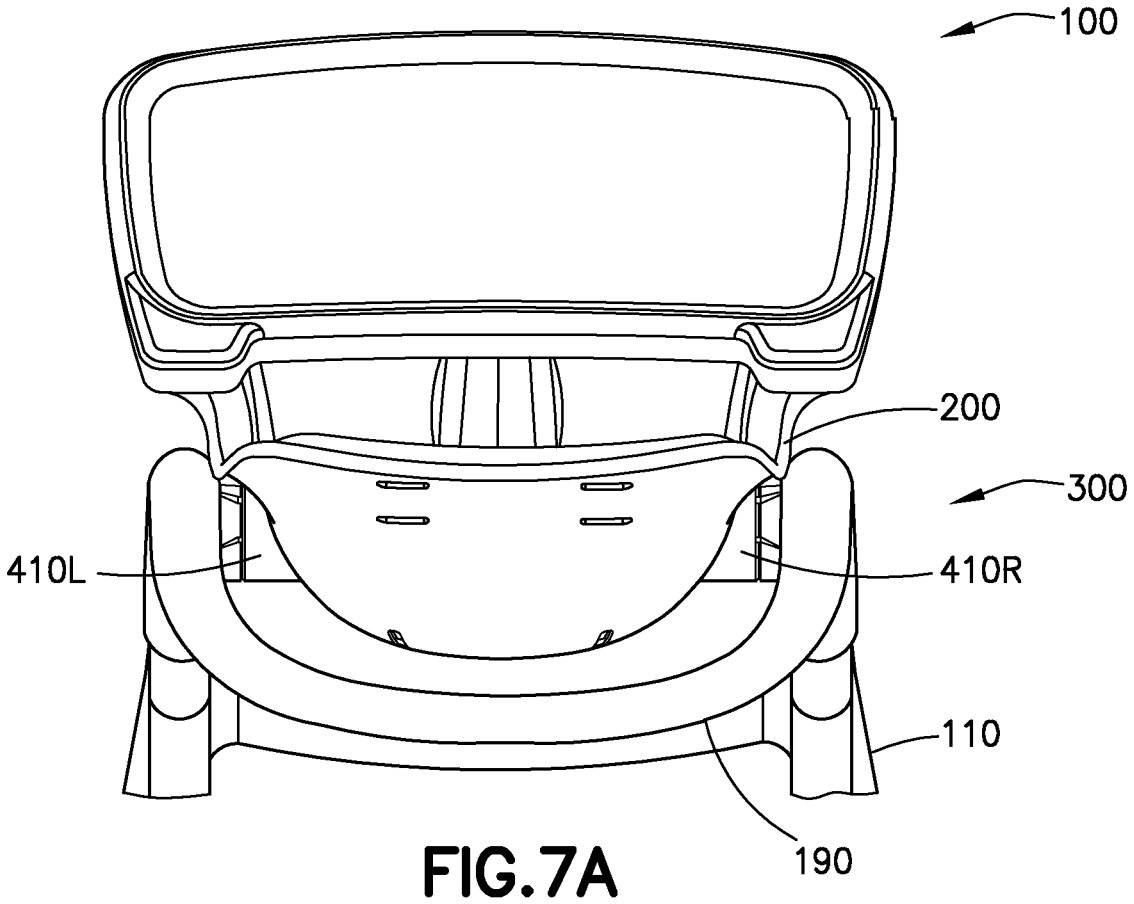
FIGS. 7A-7E schematically illustrate a seat positioning system recline assembly of the infant-supporting chair apparatus of FIGS. 1A and 1B in accordance with aspects of the present disclosure.
Figure 7B:
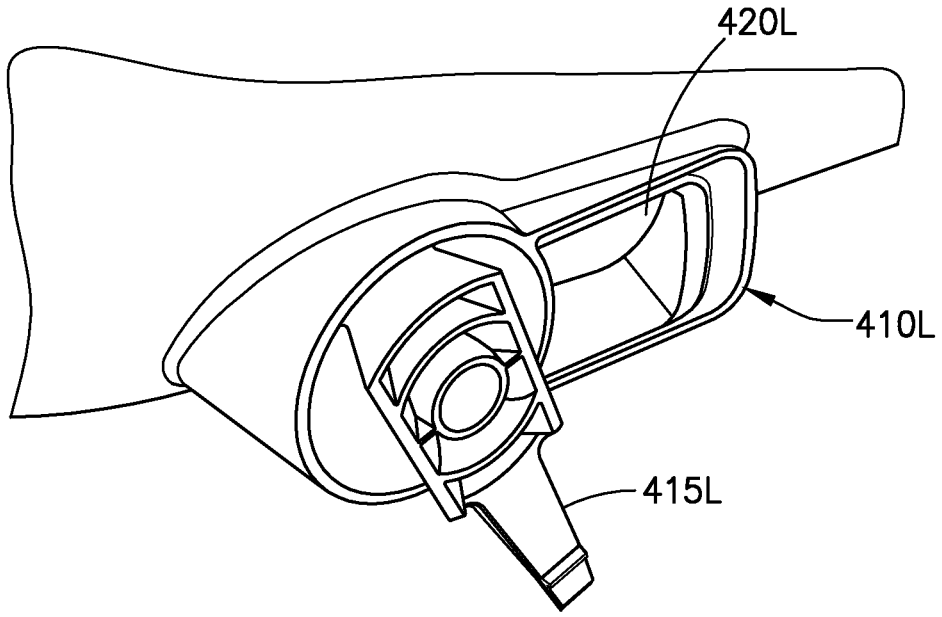
Figure 7C:
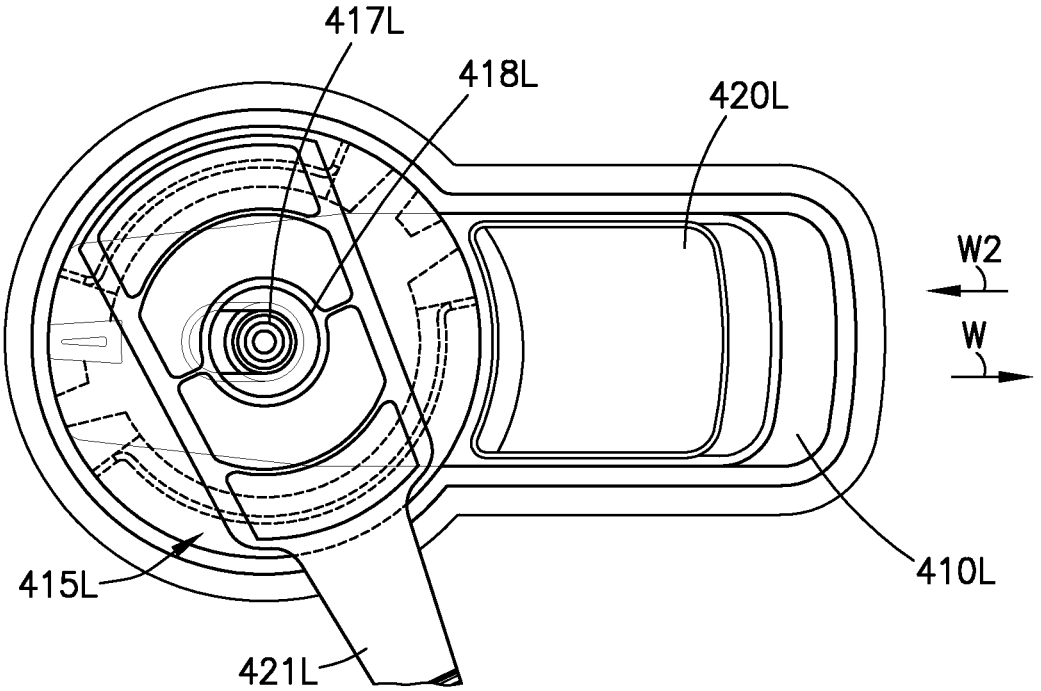
Figure 7D:
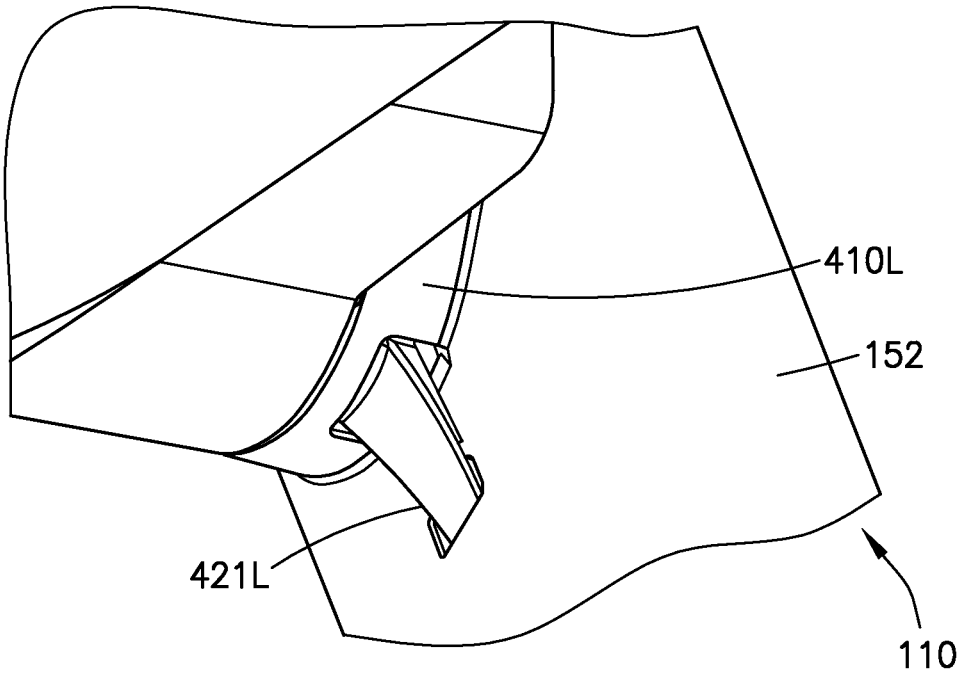
Figure 7E:
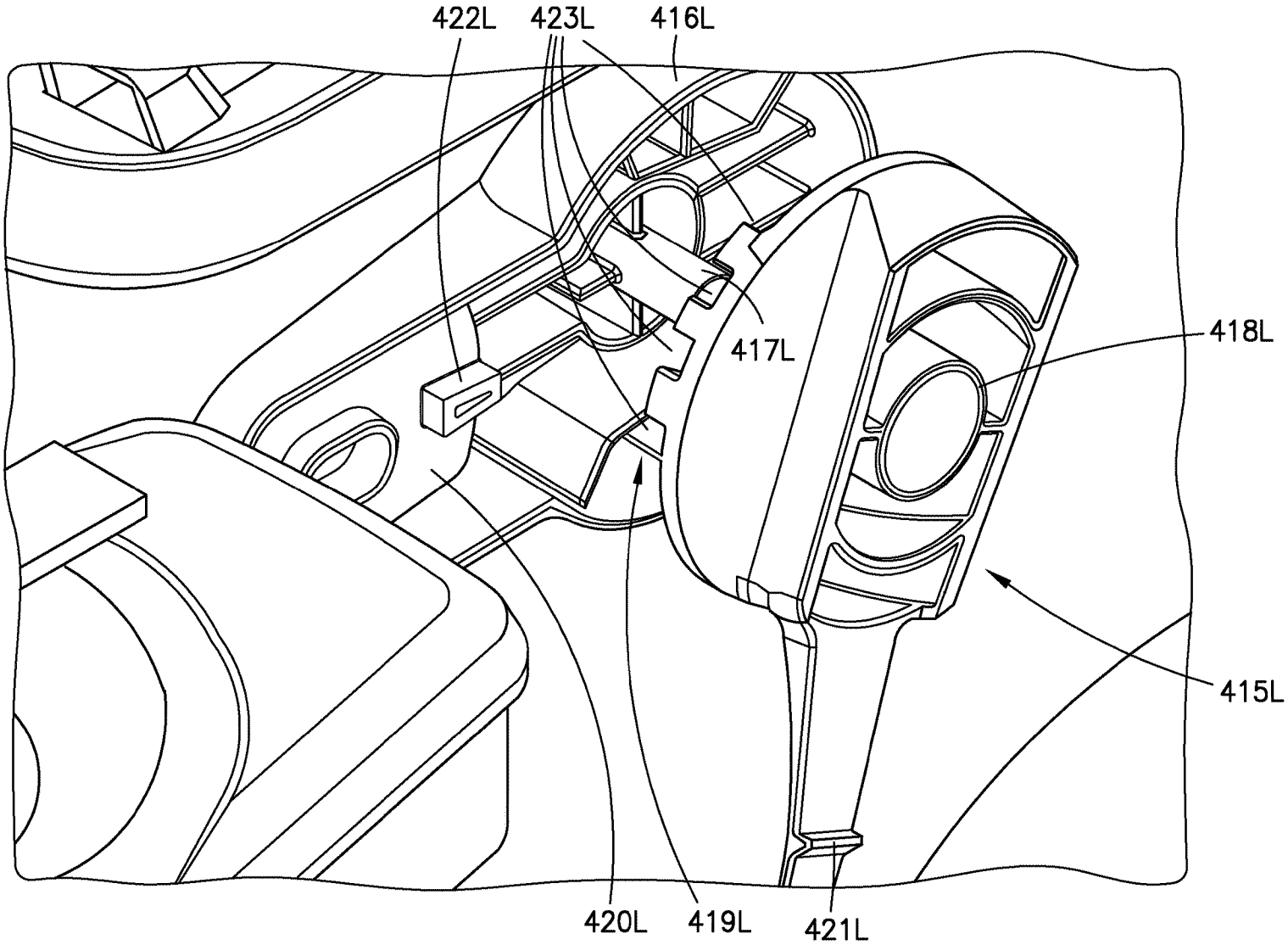

Referring to FIGS. 1A, 1B, and 7A-7E, in the illustrated aspect, as noted above, the seat 200 is movably coupled to the frame assembly 110 by the seat positioning system generally designated as 300. In at least one aspect, for example, the seat positioning system 300 comprises a right seat recline latching assembly 410R and a left seat recline latching assembly 410L, only the left seat recline latching assembly 410L is shown in FIGS. 7B-7E, but it is noted that the right seat recline latching assembly 410R is substantially similar to the left seat recline latching assembly 410L. In the illustrated aspect, the right and left seat latching assemblies 410R, 410L are identical in construction and operation and are "mirror images" of one another. FIGS. 7A-7E, illustrate various portions of the left seat recline latching assembly 410L. The left seat recline latching assembly 410L includes a left dovetail support 415L that is configured to support and rotate the seat 200 relative to the frame assembly 110. The left dovetail support 415L fits into a dovetail support casing 416L (FIG. 7E) and rotates around a dovetail support casing male connector 417L (FIGS. 7C and 7E). The dovetail support casing male connector 417L may be integral to the seat 200 or may be attached to the seat 200 using any suitable attachment means such as those described herein. The left dovetail support 415L has a dovetail support female connector 418L (FIGS. 7C and 7E) that slidably engages and rotates around the dovetail support casing male connector 417L. The left dovetail support 415L has three dovetail support teeth 419L that are configured to engage a dovetail support casing button 420L (FIGS. 7C and 7E). In other aspects, the dovetail support 415L may have any number of dovetail support teeth 419L. The left dovetail support 415L may also have a dovetail support locking feature 421L that connects or locks the dovetail support 415L to left vertical strut 152 of the frame assembly 110 (FIGS. 7C-7E).

In operation, a user may pull or otherwise move the dovetail support casing buttons 420L and 420R in the direction of arrow W (see FIG. 7C) to adjust a recline angle of the backrest 250 as will be described in greater detail below. In one aspect, the recline angle of the backrest 250 may be between 23 and 42 degrees; however, in other aspects, the recline angle may be set to any suitable angle that restrains or otherwise holds the occupant within the seat 200. The operation of the seat recline latching assemblies 410L, 410R will be described in terms of left seat recline latching assembly 410L only and it is understood that both the left seat recline latching assembly 410L and the right seat recline latching assembly 410R are actuated in a substantially similar manner to recline the seat 200. In operation, moving the dovetail support casing buttons 420L in the direction of arrow W disengages the dovetail support casing button locking tooth 422L from at least one of the dovetail support slots 423L. With the dovetail support casing button locking tooth 422L from at least one of the dovetail support slots 423L the user may recline the seat 200 to a different recline angle, causing the dovetail support 415L to rotate around the dovetail support casing male connector 417L. When the desired recline angle is achieved, the user may release the dovetail support casing button 420L, which is biased in direction W2 (FIG. 7C) by any suitable biasing member causing the support casing button locking tooth 422L to engage at least one of the dovetail support slots 423L to lock rotation of the dovetail support 415L (and the seat 200) relative to the frame assembly 110. In one aspect, the biased motion of the dovetail support casing button 420L is controlled by the biasing member which in one aspect is a spring or other suitable resilient material/member, while in other aspects, the motion of the dovetail support casing button 420L in direction W2 may be effected by any suitable device, biasing/resilient member, detents, etc. so that engagement between the dovetail support casing button locking tooth 422L and the at least one of the dovetail support slots 423L is maintained unless released by the user.

Figure 3A:
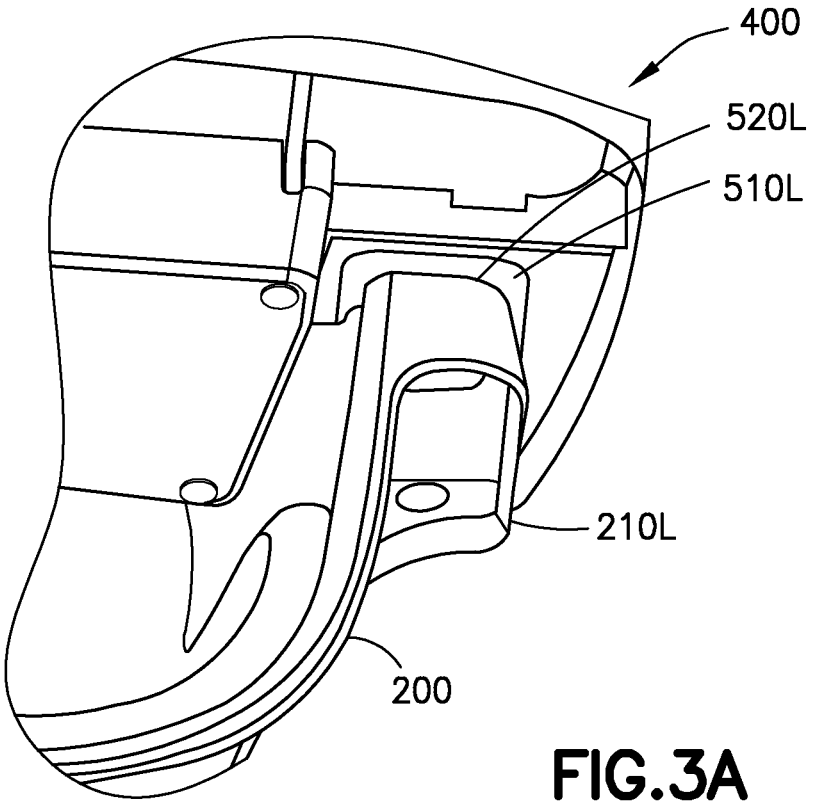
FIGS. 3A-3C schematically illustrate a unitary tray guidance and latching system of the infant-supporting chair apparatus of FIGS. 1A and 1B in accordance with aspects of the present disclosure.
Figure 3B:
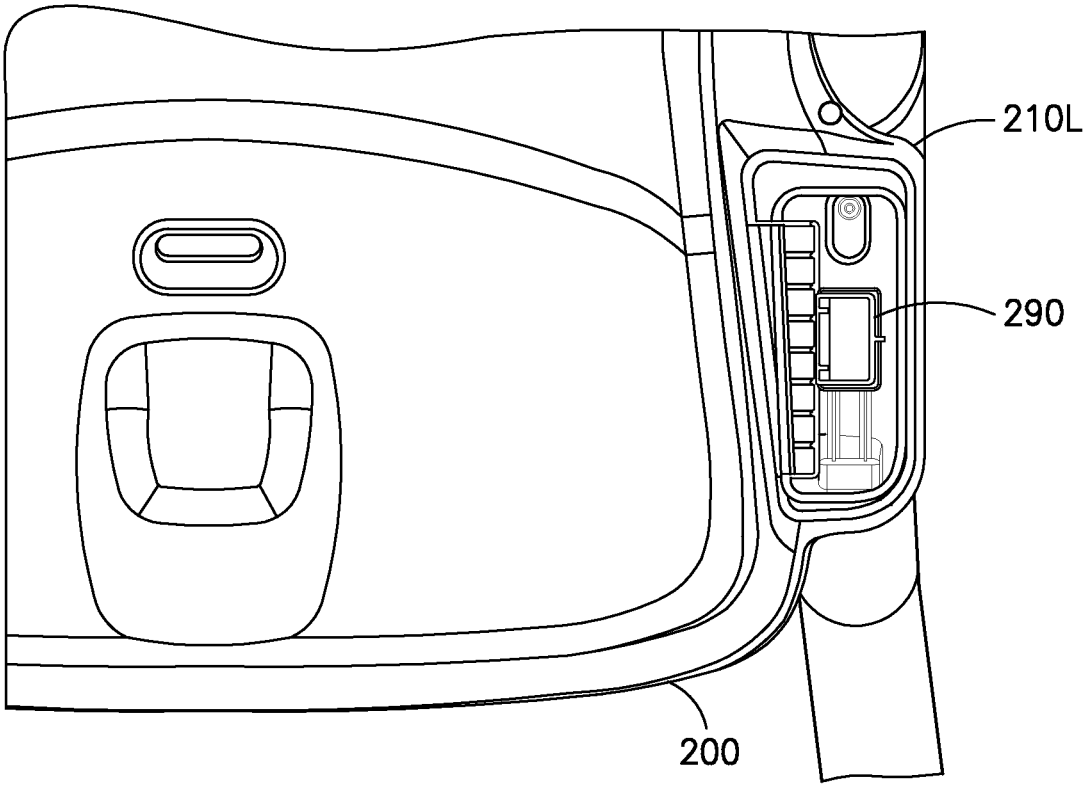
Figure 3C:
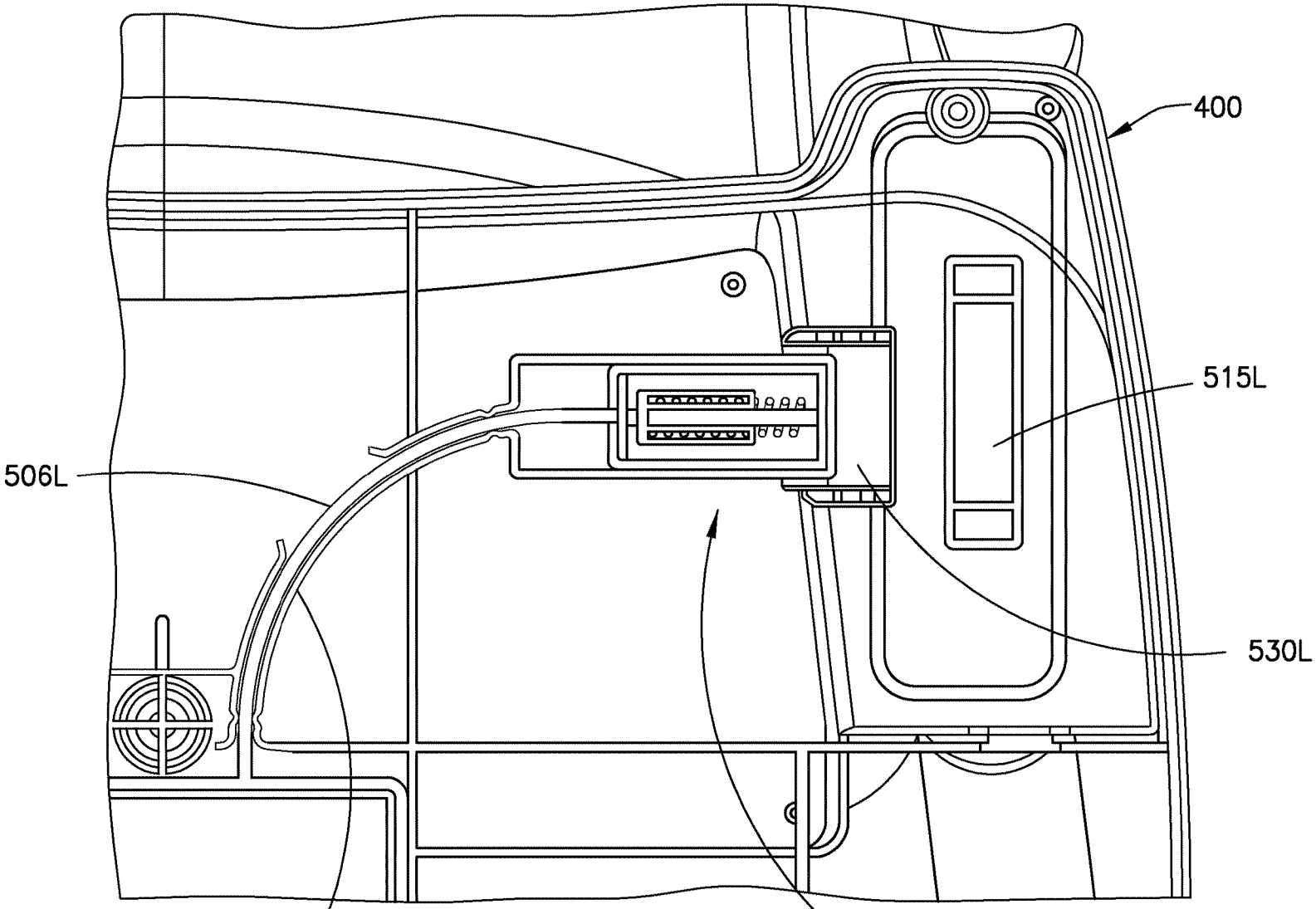
Figure 4A:
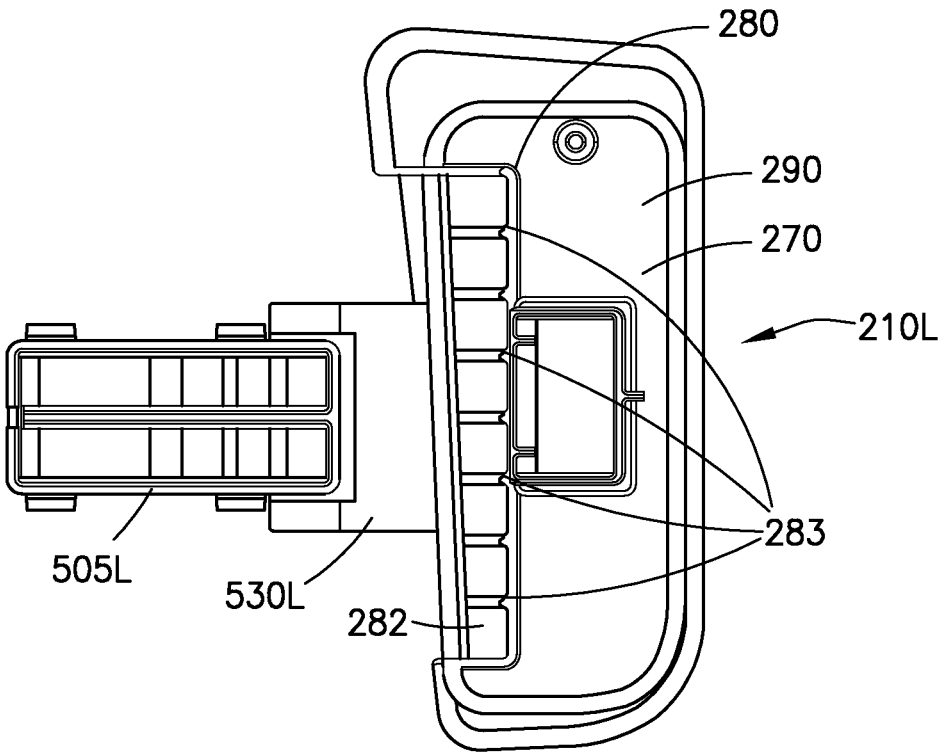
FIGS. 4A and 4B schematically illustrate the portions of the unitary tray latch system and armrest interface of the infant-supporting chair apparatus of FIGS. 1A and 1B in accordance with aspects of the present disclosure, in an engaged and partially engaged state respectively.
Figure 4B:
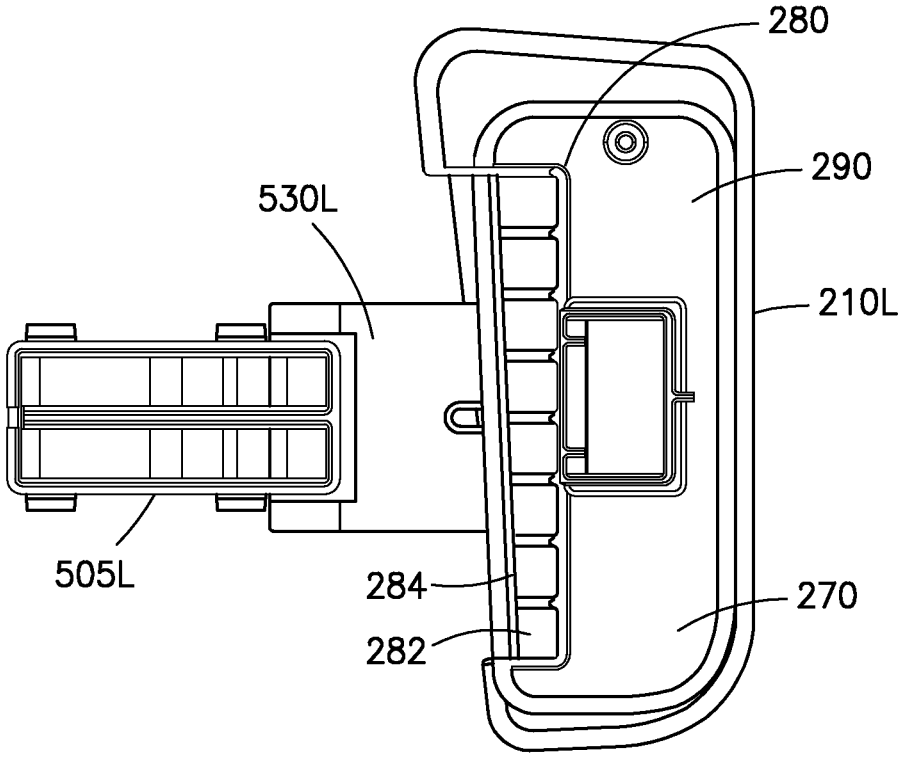

Referring now to FIGS. 1A, 1B, 2A, 2B, 4A, and 4B, and as indicated above, the seat 200 includes right armrest 210R and left armrest 210L. Each of the armrests 210R, 210L has a cavity 270 (FIGS. 2A, 2B, 4A and 4B) molded therein that is configured to accommodate a female latch receptacle 280 (FIGS. 4A and 4B). The female latch receptacle 280 has a latch slot plate 282 formed therein. The latch slot plate 282 is defined by a relatively flat or planar upper surface 284. As can also be seen in FIGS. 2A, 2B, 3A-3C, 4A, and 4B, a solid magnet 290 (also referred to as magnetic guide members) is also supported within the cavity 270 having a magnetic force in an upward direction U (see FIG. 2B). An arm cover plate 296 is attached to the corresponding armrest 210R, 210L by any suitable fasteners (such as those described herein) to cover the cavity 270 and at least a portion of the contents (e.g., the female latch receptacle 280 and solid magnet 290 noted above) therein.

Figure 2A:
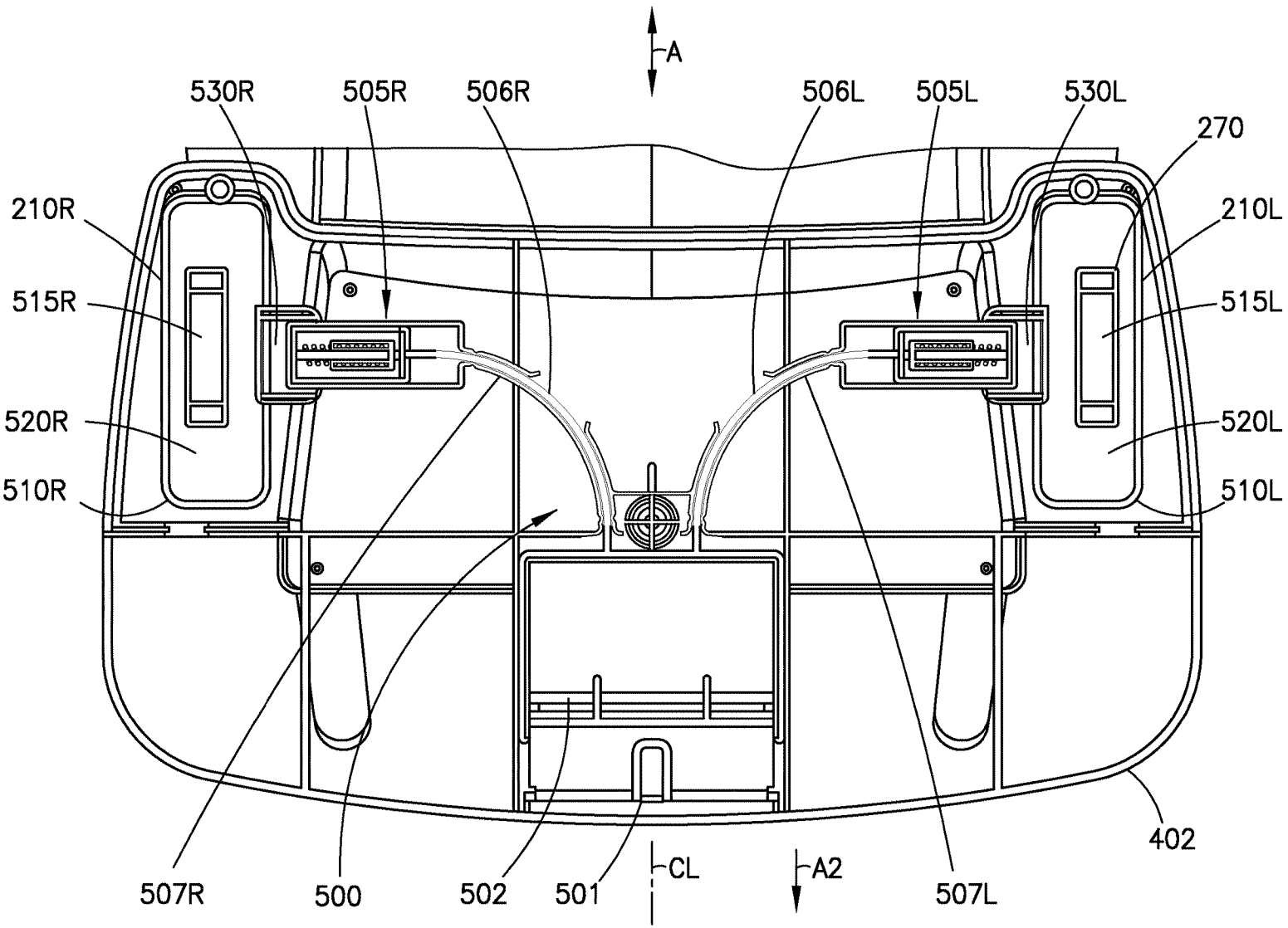
FIGS. 2A and 2B schematically illustrate a unitary tray latching system of the infant-supporting chair apparatus of FIGS. 1A and 1B in accordance with aspects of the present disclosure.
Figure 2B:
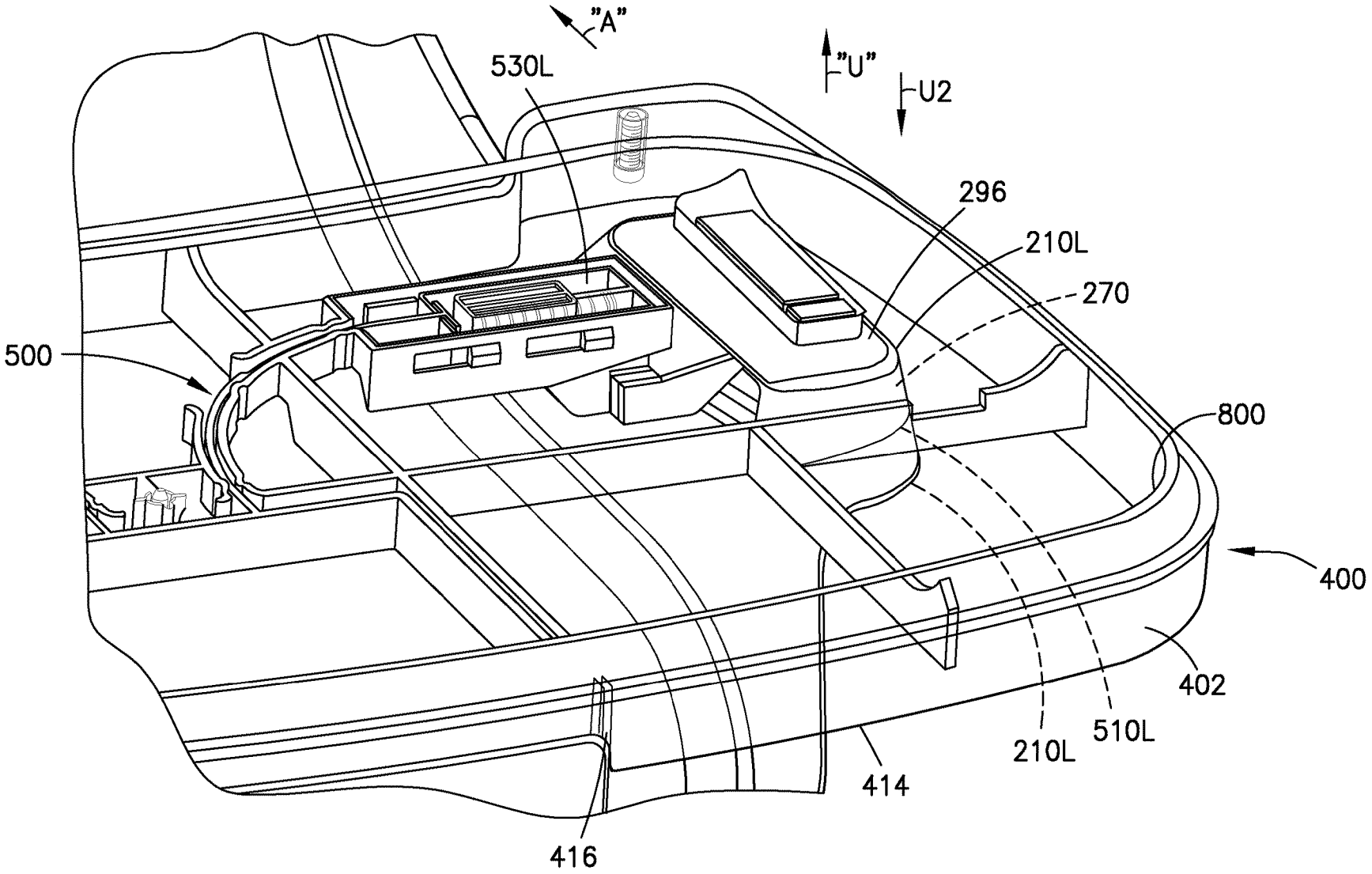

As indicated above, the chair assembly 100 also includes a tray assembly 400, which is configured to be releasably mounted to the armrests 210R, 210L of the seat 200. Referring now to FIGS. 2A and 2B, the illustrated tray assembly 400 includes a unitary tray body 402 that has a tray latching system 500 integrated into the unitary tray body 402. The unitary tray body 402 is a single piece or monolithic body (which may be comprised of multiple component parts fixedly coupled to each other to form a unitary or monolithic body (e.g., the component parts are not capable of movement relative to each other when assembled or when otherwise coupled to each other) or a single one-piece component) where the tray latching system provides for both sliding movement/adjustment of the unitary tray body 402 in a substantially horizontal direction (e.g., towards and away from the seat 200) and release of the unitary tray body 402 from the armrests 210R, 210L in at least substantially vertical direction or a direction out of plane to the plane generally formed by the tray (e.g., transverse to the substantially horizontal adjustment movement of the unitary tray body 402). The tray assembly 400 also includes a tray liner 800 that is configured to be removably coupled to the unitary tray body 402. In at least one aspect, for example, the unitary tray body 402 may be molded from plastic polypropylene, acrylonitrile butadiene styrene ("ABS"), polyoxymethylene ("POM"), nylon, or any other suitable material. In the illustrated aspect, the unitary tray body 402 includes a bottom portion 414 and a latch housing portion 416. In one aspect, the bottom portion 414 has a smooth outer surface texture that facilitates easy cleaning; however in other aspects the bottom portion 414 may have any suitable outer surface texture. In other aspects, the bottom portion 414 may have a plurality of feet (not shown) for facilitating support of the tray assembly 400 on a surface such as a table top or countertop, etc. when the tray assembly 400 has been detached from the seat 200.

Referring also to FIG. 3A, the unitary tray body 402 includes a U-shaped right docking member 510R and a U-shaped left docking member 510L, noting that only the U-shaped left docking member 510L is illustrated in FIG. 3A. The right and left docking members 510R, 510L are identical in construction and each includes a respective docking area 520R, 520L (Se FIGS. 2A and 3A). In the illustrated aspect, for example, each of the docking members 510R, 510L is molded from plastic polyoxymethylene ("POM"), acrylonitrile butadiene styrene ("ABS"), nylon, or any other suitable material; however, in other aspects, the docking members 510R, 510L may be fabricated from any suitable materials utilizing any suitable manufacturing techniques. Each docking member 510R, 510L includes a ferromagnetic element 515R and 515L respectively, such as, for example a steel bar mounted to or otherwise coupled/affixed to each docking member 510R, 510L. As will be discussed in further detail below, the right docking member 510R is configured to receive at least a portion of the top of the right armrest 210R therein and the left docking member 510L is configured to receive at least a portion of the top of the left armrest 210L therein to facilitate mechanical latching of the tray assembly 400 to the seat 200 by the tray latching system 500. In one aspect, the ferromagnetic elements 515R, 515L and the respective magnets 290 form at least a portion of a cooperative guidance and latching system. In one or more aspects, the docking members 510L, 510R and portions of the armrests noted above form at least a portion of the cooperative guidance and latching system. To facilitate "fore and aft" adjustment in the direction of arrow A of the tray assembly 400 relative to the seat 200 after the tray assembly 400 has been latched to the seat 200, each docking member 510R, 510L is selectively movable between a plurality of latching positions as will be described herein.

Referring now to FIGS. 2A and 2B, the unitary tray body 402 includes an integrated tray latching system 500 (also referred to as a multiple stage tray latching system), which in one or more aspects forms at least a portion of the cooperative guidance and latching system. The tray latching system 500 is a tactile feedback multiple stage latching system is configured to effect (as described herein) both the substantially horizontal adjustment movement of the unitary tray body 402 (and the tray assembly 400) and the at least vertical release movement of the unitary tray body 402 (and the tray assembly 400) with a single operating mechanism that is common to both the horizontal and vertical motions of the unitary tray body 402 (and tray assembly 400). The tray latching system 500 includes a release button 501 that operates in combination with a release lever 502. The operating states of the combination of the release button 501 and the release lever 502 are further shown in FIGS. 6A-6C, and discussed further below. The latching system 500 further includes a right tray latch assembly 505R and a left tray latch assembly 505L for latching and unlatching the unitary tray body 402 to and from the seat 200. The operating states and the interaction between the left tray latch assembly 505L of the unitary tray body 402 and seat 200 are further shown in FIGS. 4A and 4B, and discussed further below. The right tray latch assembly 505R and the left tray latch assembly 505L are connected to the release lever 502 by a right strap 506R and a left strap 506L respectively, where the right strap 506R and the left strap 506L are constrained by a right channel 507R and a left channel 507L respectively. The straps 506R, 506L are flexible straps and may comprise any suitable material including, but not limited to, plastic, metal, string, wire, cloth, and composite materials. The operating states of the left strap 506L and the left channel 507L are further shown in FIG. 5, and discussed further below.

The docking members 510R, 510L (only 510L is shown) may have a three position latch piece (latch piece 530L is illustrated in FIGS. 2B, 3C, 4A, and 4B with respect to docking member 510L and it should be understood that the docking member 510R includes a substantially similar latch piece 530R) attached thereto. In operation, a user may position the unitary tray body 402 so that there is a magnetic attraction between the ferromagnetic elements 515L and 515R located in the docking member 510R, 510L of the unitary tray body 402 and the magnet 290 located in each of the right armrest 210R and the left armrest 210L. The magnetic attraction guides (in some aspects, along with a configuration of a guiding engagement between the docking members 510L, 510R and the left and right armrests 210L, 210R) the unitary tray body 402 to a latching position causing the right tray latch assembly 505R and the left tray latch assembly 505L to slightly retract (e.g., engagement of the docking member 510R, 510L with a respective right tray latch assembly 505R and left tray latch assembly 505L pushes or otherwise moves the right tray latch assembly 505R and the left tray latch assembly 505L towards a centerline CL (see FIG. 2A) of the tray body 402) while the unitary tray body 402 is being guided into contact with the seat 200 in direction U2 (See FIG. 2B) by at least the magnetic attraction between the ferromagnetic elements 515L, 515R and the respective magnet 290. Once the tray assembly 400 is in the latching position the right tray latch assembly 505R and the left tray latch assembly 505L are biased, in any suitable manner, so as to automatically extend into the female latch receptacle 280 and engage the latch slot plate 282 of the right arm rest 210R and the left arm rest 210L respectively (the right tray latch assembly 505R and the left tray latch assembly 505L and the respective slot plate 282 may collectively be referred to as latching members). Thus, the magnetic attraction, between the ferromagnetic elements 515L, 515R and magnet 290, with the tray in range provide a sensible bias or pull on the tray body 402 to at least one latching position relative to the seat 200. The seating between the tray latch assembly 505L, 505R and the arm rests 210L, 210R, with the tray body 402 in the at least one latching position under such bias/pull results in a positive tactile feel that the tray body 402 is in positional engagement with the arm rests 210L, 210R with one step. Release of release button 501 (as described herein) provides for locking the tray body 402 in position relative to the seat 200 if the seat is in a desired pose, or fore and aft adjustment of the tray body 402 to a desired position with the tray body 402 engaged with the arm rests 210L, 210R.

With the unitary tray body 402 latched to the seat 200, the user may now either move the unitary tray body 402 in the "fore and aft" or horizontal direction (e.g., direction A) and/or remove the unitary tray body 402 from the seat 200 in at least the vertical direction U. To move the unitary tray body 402 in the "fore and aft" direction, the user may press and hold the release button 501 and pull the release lever 502 to a first position, causing the straps 506L and 506R to retract or otherwise move, towards centerline CL, the right tray latch assembly 505R and the left tray latch assembly 505L and partially disengage from the latch slot plate 282 located in the right arm rest 210R and the left armrest 210L respectively. With the tray latch assemblies 505R and 505L partially disengaged from the latch slot plate 282, the user may move the unitary tray body 402 in direction A to a different latch position (so as to move the tray body 402 closer or further away from the seat 200 backrest 250) and release the release lever 502 and the release button 501 causing the tray latch assemblies 505R and 505L to engage (under any suitable biasing force) with the latch slot plate 282 at the new position.

To remove the unitary tray body 402 from the seat 200, the user may press and hold the release button 501 and pull the release lever 502 to a second position, causing the straps 506L and 506R to retract or otherwise move the right tray latch assembly 505R and the left tray latch assembly 505L towards the centerline CL and fully disengage from the latch slot plate 282 located in the right arm rest 210R and the left armrest 210L respectively. With the tray latch assemblies 505R and 505L fully disengaged from the latch slot plate 282, the user may now remove the unitary tray body 402 from the seat 200, such as by moving the tray body 402 in direction U. In the aspects shown in the figures the mating configuration of the docking members 510L, 510R with the respective portions of the arm rests 210L, 210R and/or of the latch system 500 components is such that the tray body 402 is removed from the arm rests 210L, 210R substantially only in the vertical direction U; while in other aspects the mating configuration of the docking members 510L, 510R with the respective portions of the arm rests 210L, 210R may be any suitable mating configuration that allows removal of the tray body 402 from the arm rests 210L, 210R in any suitable direction(s).

Figure 6A:
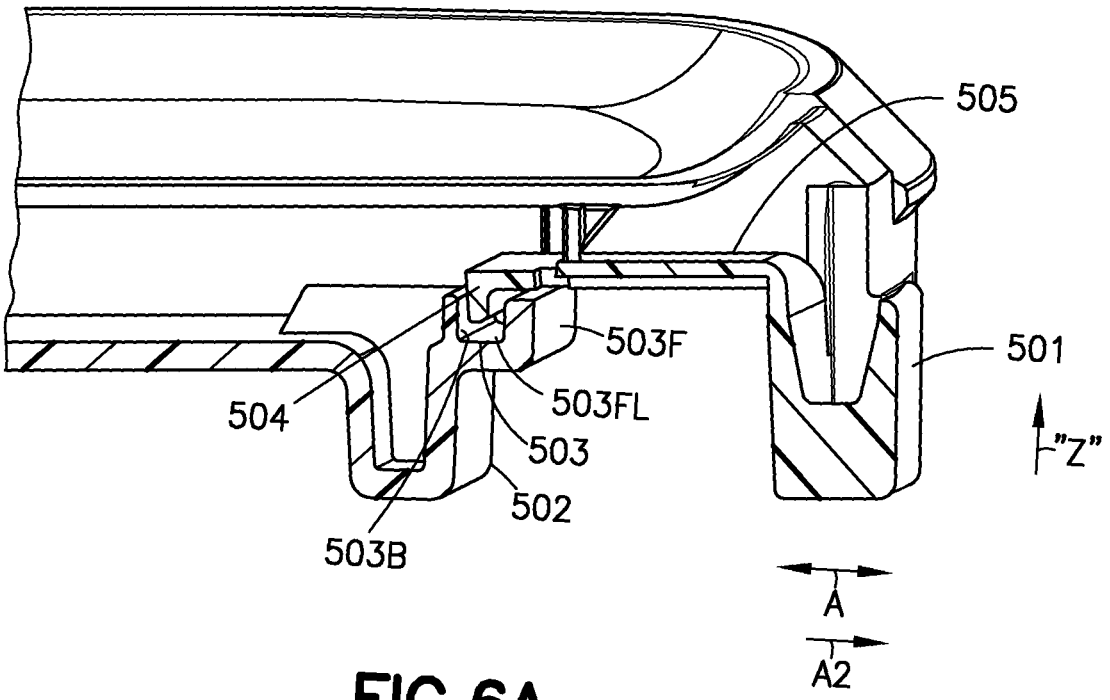
FIGS. 6A-6C schematically illustrate a unitary tray latch system release button and release handle of the infant-supporting chair apparatus of FIGS. 1A and 1B in accordance with aspects of the present disclosure, in a latched, unlatched and released state respectively.
Figure 6B:
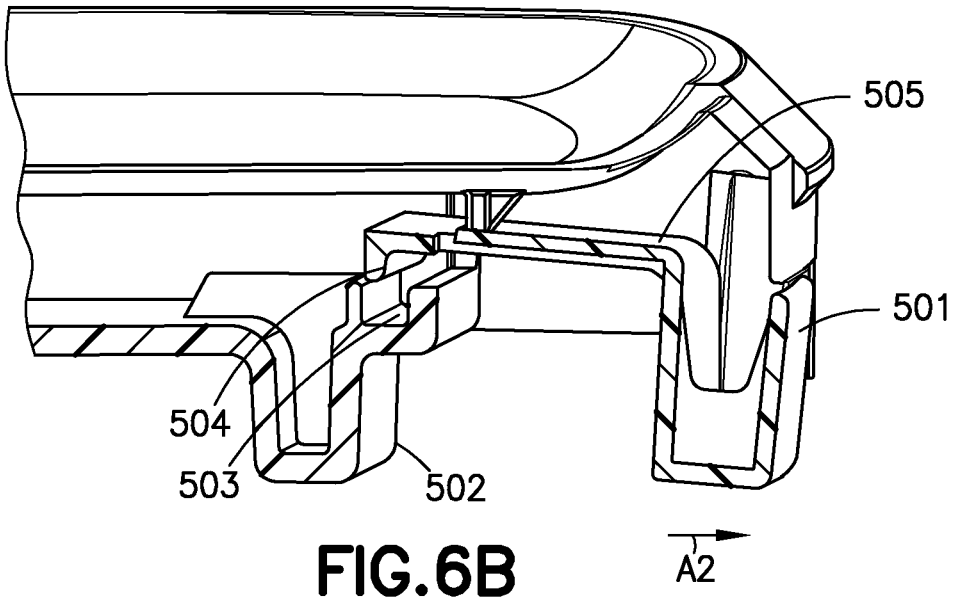
Figure 6C:
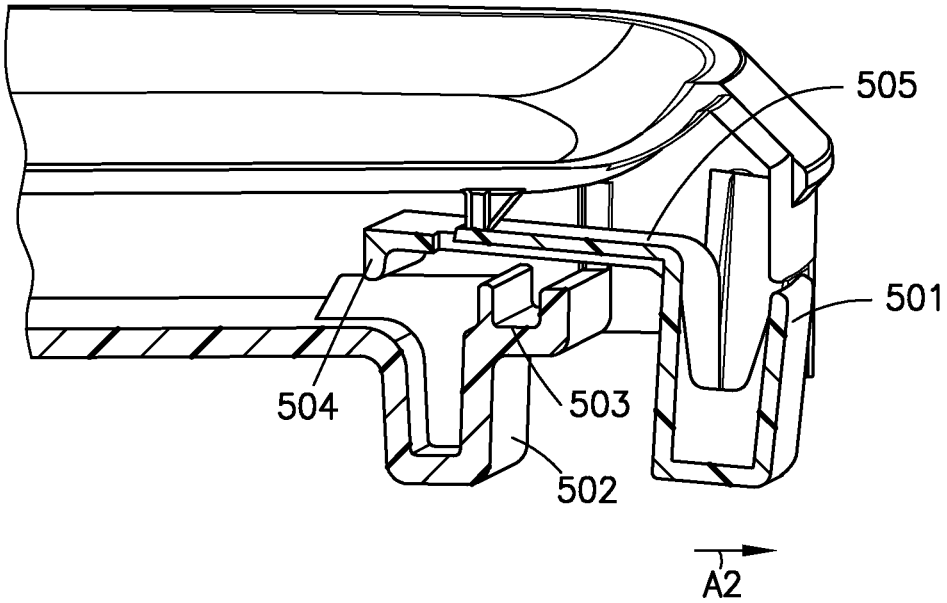

Referring now to FIGS. 6A-6C, the release button 501 includes a release button flexure 505 and a release button locking tab 504 connected to the release button flexure 505 so as to move with the release button flexure 505. The release lever 502 includes a release lever channel 503 having a channel front wall 503F, a channel back wall 503B, and a channel floor 503FL. The release lever channel 503 is configured to accept or otherwise receive at least a portion of the release button locking tab 504. FIG. 6A shows release lever 502 in a locked state or configuration, where in the locked state the release button 501 is not pressed, the locking tab 504 is inserted into the channel 503, and the release button flexure 505 may be substantially parallel with the channel floor 503FL (it should be understood that in other aspects, the release button flexure may have any suitable shape and may not be substantially parallel with the channel floor 503FL). In the locked state, the release button locking tab 504 is located within the release lever channel 503 and the contact between the release button locking tab 504 with one or more of the channel back wall 503B and the channel front wall 503F substantially prohibits a user or an occupant from pulling or pushing the release lever 502 in direction A and disengaging the right tray latch assembly 505R and the left tray latch assembly 505L of the unitary tray body 402 from the seat 200. FIG. 6C shows release lever 502 in an unlocked state or configuration, where in the unlocked state the release button 501 is pressed and the release button flexure may be flexed or otherwise move in direction Z to remove the release button locking tab 504 from the channel 503 and, in the aspect illustrated, the release button flexure 505 may be at an angle that is not substantially parallel with the channel floor 503FL. In the unlocked state, there is no contact between the release button locking tab 504 and the channel back wall 503B and a user may pull the release lever 502 and either partially or fully disengage the right tray latch assembly 505R and the left tray latch assembly 505L of the unitary tray body 402 from the seat 200. FIG. 6B shows release lever 502 in an unlocked state just prior to the release lever 502 being pulled.

Referring now to FIGS. 2A, 3C, 4A, and 4B, the left tray latch assembly 505L includes a left tray latch finger plate 530L that is configured to engage and disengage the unitary tray body 402 to and from the seat 200. As noted herein, the left armrest 210L includes the female latch receptacle 280 and the latch slot plate 282 that is located within the female latch receptacle 280. The latch slot plate 282 has 4 recess slots 283 (in other aspects there may be more or less than 4 recess slots) configured to engage the left tray latch finger plate 530L. FIG. 4A shows the left tray latch assembly 505L fully extended (e.g., so that the tray latch finger plate 530L is biased laterally away from the centerline CL (see FIG. 2A)) so that the left tray latch finger plate 530L is fully engaged into the latch slot plate 282 (it is noted that the right tray latch assembly 505R includes a substantially similar tray latch finger plate 530R). With the left and/or right tray latch finger plate 530L, 530R fully engaged with the respective latch slot plate 282 (as illustrated in FIG. 4A with respect to left tray latch finger plate 530L) the unitary tray body 402 substantially cannot be moved in the "fore or aft" direction (e.g., direction A) or removed from the seat 200. For exemplary purposes, FIG. 4B shows the left tray latch assembly 505L partially extended (e.g., so that the tray latch finger plate 530L is biased laterally away from the centerline CL (see FIG. 2A)) so that the left tray latch finger plate 530L partially engaged into the latch slot plate 282. With the left and/or right tray latch finger plate 530L, 530R partially engaged into the respective latch slot plate 282 the unitary tray body 402 may be moved in the "fore or aft" direction (e.g., direction A); however, the unitary tray body 402 cannot be removed from the seat 200 when the left and/or right latch finger plate 530L, 530R is partially engaged into the latch slot plate 282.

Figure 5:
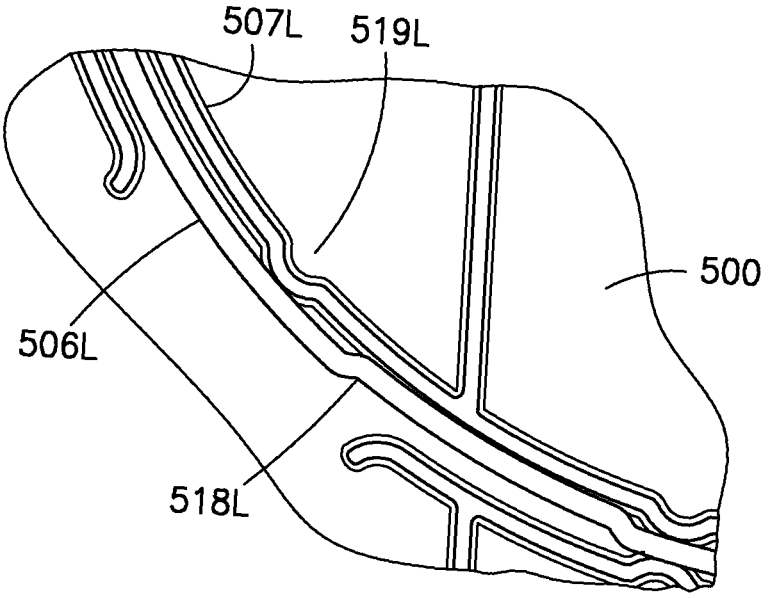
FIG. 5 schematically illustrates a unitary tray latch system two stage strap and channel of the infant-supporting chair apparatus of FIGS. 1A and 1B in accordance with aspects of the present disclosure.

Referring also to FIG. 5, latching system 500 includes a left strap 506L and left channel 507L where the left strap 506L may be constrained by left channel 507L (it is noted that the right strap 506R and the right channel 507R are similar configured such that only the left strap 506L and left channel 507L will be described). The left channel 507L may have a left channel bump 519L and the left strap 506L may have a left strap bump 518L. The interaction between the left channel bump 519L and left strap bump 518L while the release lever 502 is being pulled provide a stage indication to the user (e.g., that is felt by a user as tactile feedback through a resistance to actuation/motion of the release lever 502) at a first stage (e.g., the first stage being where the tray latch finger plate 530L is partially retracted from the latch slot plate 282) and then again at a second stage (e.g., the second state being where the tray latch finger plate 530L is fully retracted from the latch slot plate 282). The tactile feedback distinctly identifies each of the first stage and second stage so that the first stage is distinct from the second stage in a commutable manner. Here, at least the release lever 502 and the straps 506R, 506L may be referred to as a multiple stage operating mechanism. In operation, a user may pull or otherwise move the release lever 502 in direction A2 (see FIGS. 2A and 6A-6C) until the user feels resistance in the release lever 502. This resistance is caused by the interaction between the left channel bump 519L and left strap bump 518L while the user is pulling the release lever 502. When the user feels the resistance, it is an indicator that the latching system 500 is at stage one and the latch finger plate 530L is partially disengaged from the latch slot plate 282 so that the user can adjust the unitary tray body 402 in the "fore and aft" direction. The user may overcome the resistance caused by the interaction between the left channel bump 519L and left strap bump 518L by further pulling or otherwise moving the release lever 502 in direction A2 so that the latching system 500 moves to stage two (movement of the release lever 502 in direction A2 may be limited in any suitable manner such as by any suitable hard stops or limits of travel of the tray latch finger plates 530L, 530R) so that the latch finger plate 530L is fully disengaged from the latch slot plate 282 and the user can remove the unitary tray body 402 from the seat 200. As can be seen above, actuation of the release lever 502 is common to both the horizontal adjustment movements of the tray body 402 relative to the seat 200 and the vertical removal movement of the tray body 402 relative to the frame assembly 110/arm rests 210L, 210R.

In accordance with one or more aspects of the disclosed embodiment an infant supporting chair is provided. The infant supporting chair including a frame, a seat movably supported on the frame, a unitary tray, a cooperative guidance and latching system configured to magnetically pull the unitary tray toward at least one latching position with the unitary tray in range of the at least one latching position relative to the seat, releasably secure the unitary tray to the seat with the unitary tray engaged to the at least one latching position, and slidably position the unitary tray relative to the seat with the unitary tray partially disengaged from the at least one latching position.

In accordance with one or more aspects of the present disclosure the latching system is a two stage latching system.

In accordance with one or more aspects of the present disclosure the seat is movable in a height direction.

In accordance with one or more aspects of the present disclosure the seat is moveable in a recline angle direction.

In accordance with one or more aspects of the present disclosure the cooperative guidance and latching system is integrated into the unitary tray.

In accordance with one or more aspects of the present disclosure the cooperative guidance and latching system is integrated into the unitary tray.

In accordance with one or more aspects of the present disclosure the cooperative guidance and latching system is further configured for removal of the unitary tray from the frame in a direction substantially transverse to a sliding direction of the unitary tray when the unitary tray is completely disengaged from the at least one latching position.

In accordance with one or more aspects of the present disclosure an infant supporting chair comprises a frame, a seat coupled to the frame, a unitary tray, and a multiple stage tray latching system configured to releasably couple the unitary tray to the frame. The multiple tray latching system comprises: magnetic guide members that are configured to move the unitary tray towards the frame and effect locking engagement of the unitary tray and seat with the multiple stage tray latching system, latching members that couple the unitary tray to the frame in one of a number of horizontal positions relative to the seat, and a multiple stage operating mechanism having distinct operational stages that effect both a partial disengagement of the latching members and complete disengagement of the latching members, wherein: the partial disengagement of the latching member effects horizontal movement of the unitary tray between the number of horizontal positions, and the complete disengagement of the latching members effects removal of the unitary tray from the frame in a direction transverse to the horizontal movement of the unitary tray.

In accordance with one or more aspects of the present disclosure the multi-stage operating mechanism comprises a lever and the distinct operation stages are identified by tactile feedback through movement of lever.

In accordance with one or more aspects of the present disclosure the multi stage operating system comprises at least one flexible strap coupling the lever to the latching members and the unitary tray comprises at least one channel in which the at least one flexible strap is disposed, the at least one flexible strap and the at least one channel having detent features that engage one another to identify the distinct operational stages.

In accordance with one or more aspects of the present disclosure the latching members comprise: a finger plate slidably coupled to the unitary tray; and a latch slot plate coupled to the frame; wherein the multi-stage operating mechanism is coupled to the finger plate to effect staged movement of the finger plate relative to the latch slot plate.

In accordance with one or more aspects of the present disclosure the infant supporting chair further comprises a seat recline latching assembly that rotatably couples the seat to the frame.

In accordance with one or more aspects of the present disclosure the seat recline latching assembly comprises a slide lock that locks the seat in one of a number of rotation positions relative to the frame.

In accordance with one or more aspects of the present disclosure the infant supporting chair further comprises a seat height latching assembly configured to slidably couple the seat to the frame.

In accordance with one or more aspects of the present disclosure the seat height latching assembly comprises a pivot lock that locks the seat in one of a number of height positions relative to the frame.

In accordance with one or more aspects of the present disclosure an infant supporting chair comprises a frame, a seat coupled to the frame, a unitary tray coupled to the seat in one of a number of latching positions, and a cooperative guidance and multiple stage latching system configured to magnetically guide latching engagement of the unitary tray to the seat in the one of the number of latching positions, wherein the cooperative guidance and multiple stage latching system comprises: a first stage having partial disengagement of a latch portion of the cooperative guidance and multiple stage latching system between the unitary tray and the seat and a second stage having full disengagement of the latch portion of the cooperative guidance and multiple stage latching system between the unitary tray and the seat. The partial disengagement: effects a change from the one of the number of latching positions to another of the number of latching positions with a sliding movement of the unitary tray relative to the seat, and substantially prevents removal of the unitary tray from the seat. The full disengagement effects removal of the unitary tray from the seat. The multiple stage operation of the latch portion of the cooperative guidance and multiple stage latching system is effected with but a single actuating lever.

In accordance with one or more aspects of the present disclosure the first stage and second stage are differentiated from each other by tactile feedback through movement of the single actuating lever.

In accordance with one or more aspects of the present disclosure the latch portion of the cooperative guidance and multiple stage latching system comprises at least one flexible strap coupling the single actuating lever to latching members, and the unitary tray comprises at least one channel in which the at least one flexible strap is disposed, the at least one flexible strap and the at least one channel having detent features that engage one another to distinctly identify the first stage and the second stage.

In accordance with one or more aspects of the present disclosure the latching members comprise a finger plate slidably coupled to the unitary tray, and a latch slot plate coupled to the frame.

In accordance with one or more aspects of the present disclosure the infant supporting chair further comprises a seat recline latching assembly that rotatably couples the seat to the frame.

In accordance with one or more aspects of the present disclosure the infant supporting chair further comprises a seat height latching assembly configured to slidably couple the seat to the frame.

It should be understood that the foregoing description is only illustrative of the aspects of the present disclosure. Various alternatives and modifications can be devised by those skilled in the art without departing from the aspects of the present disclosure. Accordingly, the aspects of the present disclosure are intended to embrace all such alternatives, modifications and variances that fall within the scope of any claims appended hereto. Further, the mere fact that different features are recited in mutually different dependent or independent claims does not indicate that a combination of these features cannot be advantageously used, such a combination remaining within the scope of the aspects of the present disclosure.

What is claimed is:

1. An infant supporting chair comprising:
a frame;
a seat movably supported on the frame;
a unitary tray; and
a cooperative guidance and latching system configured to:
magnetically pull the unitary tray, as a unit that is a one piece assembly, toward at least one latching position with the unitary tray in range of the at least one latching position relative to the seat,
releasably secure the unit of the one piece assembly unitary tray, the unit releasably secured and magnetically pulled being common, to the seat with the unitary tray engaged to the at least one latching position, and
slidably position the unit of the one piece assembly unitary tray, the unit slidably positioned being the one piece assembly common to at least one of the unit releasably secured and magnetically pulled, relative to the seat with the unitary tray partially disengaged from the at least one latching position.

2. The infant supporting chair of claim 1, wherein the cooperative guidance and latching system is a two stage latching system.

3. The infant supporting chair of claim 1, wherein the seat is movable in a height direction.

4. The infant supporting chair of claim 1, wherein the seat is moveable in a recline angle direction.

5. The infant supporting chair of claim 1, wherein the cooperative guidance and latching system is integrated into the unitary tray.

6. The infant supporting chair of claim 1, wherein the cooperative guidance and latching system is further configured for removal of the unitary tray from the frame in a direction substantially transverse to a sliding direction of the unitary tray when the unitary tray is completely disengaged from the at least one latching position.

7. An infant supporting chair comprising:
a frame;
a seat coupled to the frame;
a unitary tray; and
a multiple stage tray latching system configured to releasably couple the unitary tray to the frame, the multiple tray latching system comprising:
magnetic guide members that are configured to move the unitary tray, as a unit, towards the frame and effect locking engagement of the unitary tray and seat with the multiple stage tray latching system,
latching members that couple the unitary tray, as a unit, to the frame in one of a number of horizontal positions relative to the seat, and
a multiple stage operating mechanism having distinct operational stages effected with a common movement of the multiple stage operating mechanism, the distinct operational stages effect both a partial disengagement of the latching members and complete disengagement of the latching members,
wherein:
the partial disengagement of the latching member effects the horizontal movement of the unitary tray, as a unit, between the number of horizontal positions, and
the complete disengagement of the latching members effects the removal of the unitary tray, as a unit, from the frame in a direction transverse to the horizontal movement of the unitary tray.

8. The infant supporting chair of claim 7, wherein the multi-stage operating mechanism comprises a lever and the distinct operation stages are identified by tactile feedback through movement of the lever.

9. The infant supporting chair of claim 8, wherein the multi stage operating system comprises at least one flexible strap coupling the lever to the latching members and the unitary tray comprises at least one channel in which the at least one flexible strap is disposed, the at least one flexible strap and the at least one channel having detent features that engage one another to identify the distinct operational stages.

10. The infant supporting chair of claim 7, wherein the latching members comprise:
a finger plate slidably coupled to the unitary tray; and
a latch slot plate coupled to the frame;
wherein the multi-stage operating mechanism is coupled to the finger plate to effect staged movement of the finger plate relative to the latch slot plate.

11. The infant supporting chair of claim 7, further comprising a seat recline latching assembly that rotatably couples the seat to the frame.

12. The infant supporting chair of claim 11, wherein the seat recline latching assembly comprises a slide lock that locks the seat in one of a number of rotation positions relative to the frame.

13. The infant supporting chair of claim 7, further comprising a seat height latching assembly configured to slidably couple the seat to the frame.

14. The infant supporting chair of claim 13, wherein the seat height latching assembly comprises a pivot lock that locks the seat in one of a number of height positions relative to the frame.

15. An infant supporting chair comprising:

a frame;

a seat coupled to the frame;

a unitary tray coupled to the seat in one of a number of latching positions; and a cooperative guidance and multiple stage latching system configured to magnetically guide latching engagement of the unitary tray to the seat in the one of the number of latching positions, wherein the cooperative guidance and multiple stage latching system comprises:

a first stage having partial disengagement of a latch portion of the cooperative guidance and multiple stage latching system between the unitary tray and the seat, which partial disengagement:

effects a change from the one of the number of latching positions to another of the number of latching positions with a sliding movement of the unitary tray, as unit, relative to the seat, and substantially prevents removal of the unitary tray, as a unit, from the seat;

a second stage having full disengagement of the latch portion of the cooperative guidance and multiple stage latching system between the unitary tray and the seat, which full disengagement effects removal of the unitary tray, as a unit, from the seat; and wherein multiple stage operation of the latch portion of the cooperative guidance and multiple stage latching system is effected with but a single actuating lever.

16. The infant supporting chair of claim 15, wherein the first stage and second stage are differentiated from each other by tactile feedback through movement of the single actuating lever.

17. The infant supporting chair of claim 15, wherein the latch portion of the cooperative guidance and multiple stage latching system comprises at least one flexible strap coupling the single actuating lever to latching members, and the unitary tray comprises at least one channel in which the at least one flexible strap is disposed, the at least one flexible strap and the at least one channel having detent features that engage one another to distinctly identify the first stage and the second stage.

18. The infant supporting chair of claim 17, wherein the latching members comprise:

a finger plate slidably coupled to the unitary tray; and a latch slot plate coupled to the frame.

19. The infant supporting chair of claim 15, further comprising a seat recline latching assembly that rotatably couples the seat to the frame.

20. The infant supporting chair of claim 15, further comprising a seat height latching assembly configured to slidably couple the seat to the frame.

* * * * *